United States Patent [19]

Chiang

[11] Patent Number: 4,805,499

[45] Date of Patent: Feb. 21, 1989

[54] ADJUSTABLE CUTTING-LENGTH CONTROLLER AND A CUTTING MACHINE THEREOF

[76] Inventor: Chang-Long Chiang, P.O. Box 10160, Taipei, Taiwan

[21] Appl. No.: 86,797

[22] Filed: Aug. 18, 1987

[51] Int. Cl.[4] ..... B26D 5/34

[52] U.S. Cl. ..... 83/71; 83/203; 83/208; 83/520

[58] Field of Search ..... 83/203, 208, 211, 212, 83/240, 283, 399, 71, 72, 520

[56] References Cited

U.S. PATENT DOCUMENTS

| | | | |
|---|---|---|---|
| 3,443,867 | 5/1969 | Scheffel | 83/412 |
| 3,760,669 | 9/1973 | Rosenthal et al. | 83/208 X |
| 3,962,940 | 6/1976 | Schleifenbaum et al. | 83/208 |
| 3,986,419 | 10/1976 | Cleghorn | 83/208 X |

*Primary Examiner*—Frank T. Yost
*Assistant Examiner*—Hien H. Phan

[57] ABSTRACT

A cutting machine includes a bright/dark color cylinder having a triangle bright area formed thereon as driven by a driving shaft synchronously driving a set of conveying rollers forwarding a strip of article to be cut and driving a pair of cutting knives, and a photo controller longitudinally moving above the bright/dark color cylinder to sense a light signal from the triangular bright area of the cylinder to run the rollers and the strip, and/or to shield the light signal from a dark color area on the cylinder to thereby stop the rollers and the strip adapted to be cut by the cutting knives, whereby upon the moving of the photo controller above the cylinder, a linear length of the triangle bright area on the cylinder periphery can be adjusted to thereby optionally adjust the cutting length of the strip article.

5 Claims, 3 Drawing Sheets

ADJUSTABLE CUTTING-LENGTH CONTROLLER AND A CUTTING MACHINE THEREOF

BACKGROUND OF THE INVENTION

For cutting a long strip of surface-printed paper board, plastic bag, metal plate or packing case into a desired length, a conventional cutting machine with a photoelectric sensor is applied for cutting such a strip in that the long strip of printed article should be printed with plural cutting marks equally spaced on the strip so that when the strip, driven by a pair of conveying rollers, having the cutting mark of dark color sensed by the photo sensor, the conveying rollers will stop the strip as actuated by the sensor and a pair of cutting knives will cut the strip at the cutting mark to obtain the desired length of printed article. However, such a conventional cutting machine has the following defects:

1. If a strip of plastic sheet is transparent or not suitable for printing such cutting marks, the machine will not be applicable since the photo sensor will not be actuated due to lacking of light signal exerting from such cutting marks.

2. If the cutting marks are missing, or falsely printed or inaccurately placed on the strip, the cutting machine may not cut the strip or may cut the strip unprecisely.

3. Since the cutting marks must be pre-printed on the strip, the cutting machine can only cut the strip at predetermined length, unable to optionally adjust any desired cutting length directly on the machine.

The present inventor has found the defects of such a conventional cutting machine and invented the adjustable cuttinglength controller for a cutting machine.

SUMMARY OF THE INVENTION

The object of the present invention is to provide a cutting length controller for a cutting machine including a bright and dark color cylinder having a triangle bright area thereon as driven by a driving shaft synchronously driving a set of conveying rollers forwarding a strip of article to be cut and driving a pair of cutting knives, and a photoelectric controller longitudinally moving above the bright and dark color cylinder to sense a light signal from the triangular bright area of the cylinder to run the rollers and the strip, and/or to shield the light signal from a dark area of the cylinder to thereby stop the rollers and the strip article, adapted to be cut by the pair of cutting knives, whereby upon the moving of the photo controller above the cylinder, a linear length of the triangle bright area on the cylinder periphery can be adjusted to thereby optionally adjust the cutting length of the strip article, without direct sensing on the strip to be cut.

DETAILED DESCRIPTION

Figure 1:
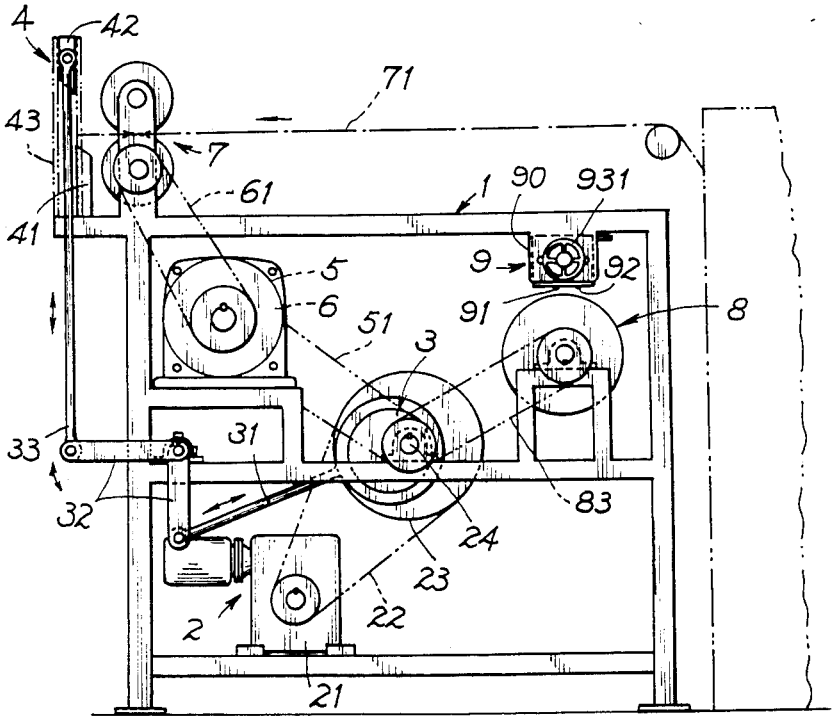
FIG. 1 is a front-elevation view of the present invention.
Figure 2:
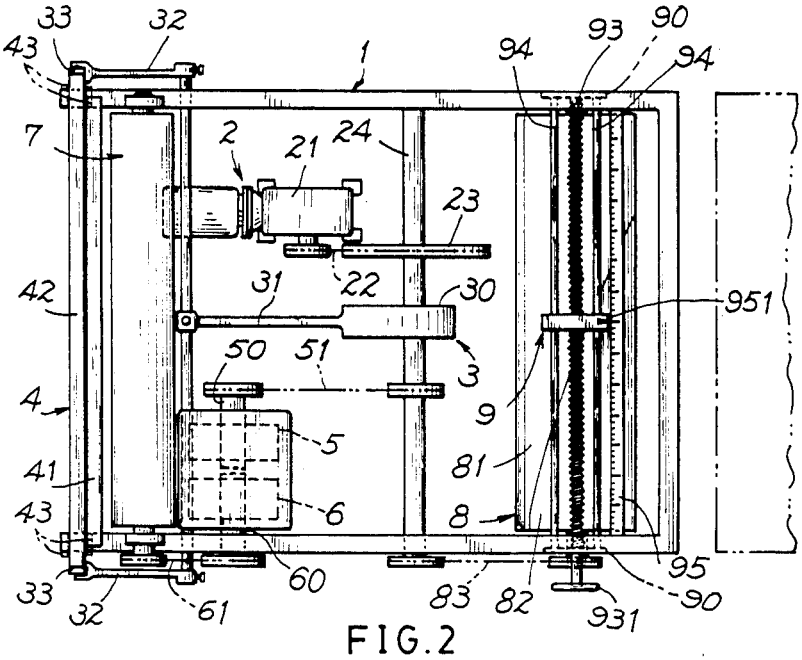
FIG. 2 is a top view of the present invention.

As shown in the figures, the present invention comprises: a frame 1, a driving motor 2, an eccentric-wheel transmission mechanism 3, a pair of cutting knives 4, an electromagnetically-operating clutch 5, an electromagnetically-operating brake 6, a set of conveying rollers 7 forwarding a long strip of article 71 to be cut such as: plastic bag, paper sheet, thin metal plate, etc., a bright and dark color cylinder 8 and a photo-electric controller 9.

The driving motor 2 is coupled to a driving shaft 24 through a speed-reducing gear set 21, a toothed belt 22 and a gear 23 on the shaft 24 rotatably mounted on frame 1. The driving shaft 24 is also mounted with an eccentric wheel 30 of the eccentric-wheel transmission mechanism 3 including the eccentric wheel 30, an eccentric link 31 pivotally connected to the eccentric wheel 30, a crank means 32 pivotally secured to the eccentric link 31 and rotatably mounted on the frame 1, and a pair of vertically reciprocating rods 33 pivotally connected with the crank means 32 and connected with an upper cutting knife 42 of the cutting knives 4 having the upper cutting knife 42 vertically reciprocated with respect to a lower cutting knife 41 for cutting the strip 71 as moving along a guide 43 vertically formed on the frame 1. The lower knife 41 should be posed under a level C of the forwarding strip 71.

The electromagnetically-operating clutch 5 (normal open) includes an input shaft 50 coupled to the driving shaft 24 by a toothed belt 51. The electromagnetically-operating brake 6 (normal close) includes an output shaft 60 coupled to the set of conveying rollers 7 by means of a toothed belt 61. The shaft 50 is operatively coupled to the shaft 60 for transmitting an output from the driving shaft 24.

Figure 3:
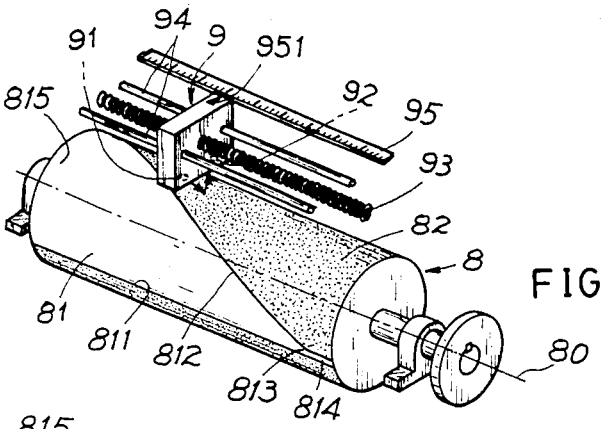
FIG. 3 is a perspective illustration of a cylinder and a photoelectric controller of the present invention.
Figure 4:
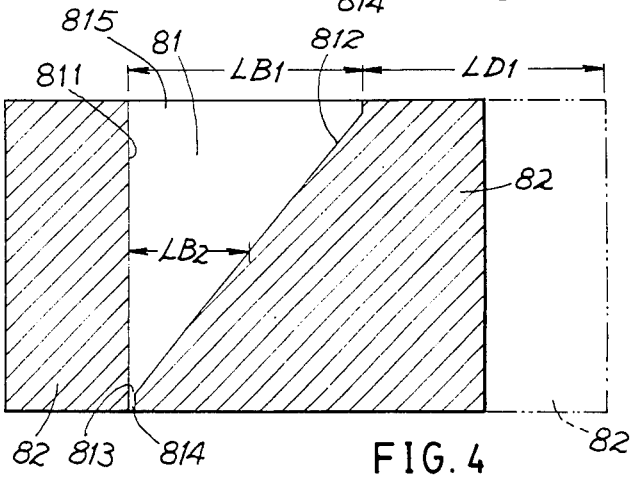
FIG. 4 is a hypothetic extended illustration showing the cylinder of the present invention.

The bright and dark color cylinder 8 as shown in FIGS. 3 and 4 includes a bright-color area 81 and a dark-color area 82 formed on an area besides an area as disposed by the bright-color area 81 on the periphery of the cylinder 8. The bright-color area 81 is a right triangle having a base 815 coinciding with a perimeter of a first circular plane of the cylinder 8, an altitude 811 parallel to a longitudinal axis of the cylinder, a vertex 813 formed approximately to a second circular plane of the cylinder opposite to the first circular plane, a bright-color slit area 814 extending outwardly from the vertex 813 towards the second circular plane along the altitude 811 of the triangle area 81, and a side leg 812 diagonally connected between the vertex 813 and the base 815. The cylinder 8 has its rotating shaft horizontally rotatably mounted on the frame 1 and coupled to the driving shaft 24 by a toothed belt 83.

The photo-electric controller 9 adjustably moving above the cylinder 8 along an axis parallel to a longitudinal axis 80 of a rotating shaft of cylinder 8 includes: a photo sensor having a light emitter 91 projecting a light beam towards an upper surface of the cylinder 8 and a photo-electric cell 92 receiving a light signal as reflected from the cylinder 8 adapted for transmitting the light signal converted to an electric signal which is then amplified to actuate a pair of relays (not shown) for respectively driving the electromagnetically operating clutch 5 as normally opened or the brake 6 as normally closed, a screw 93 engaged in the controller 9 horizontally rotatably mounted on the frame 1 by means of two brackets 90 fixed on two opposite sides across the frame 1, a pair of guide rods 94 horizontally mounted on the two brackets 90 for slidingly mounting the photo controller 9 thereon, a driving wheel 931 fixed on an outermost and of the screw 93 beyond one bracket 90 for rotating the screw 93 and adjustably moving the photo controller 9 along the guide rods 94, and a scale 95 fixed on the frame 1 in parallel with the screw 93 adapted for the indication by a pointer 951 formed on the controller 9. The graduations formed on the scale 95 are formed to show a cutting length of the strip article 71 to be cut which is proportional to a linear length (distance) circumferentially defined on the triangle bright-color area 81 of the cylinder 8 in parallel with the base 815 of the triangle area 81.

Figure 5:
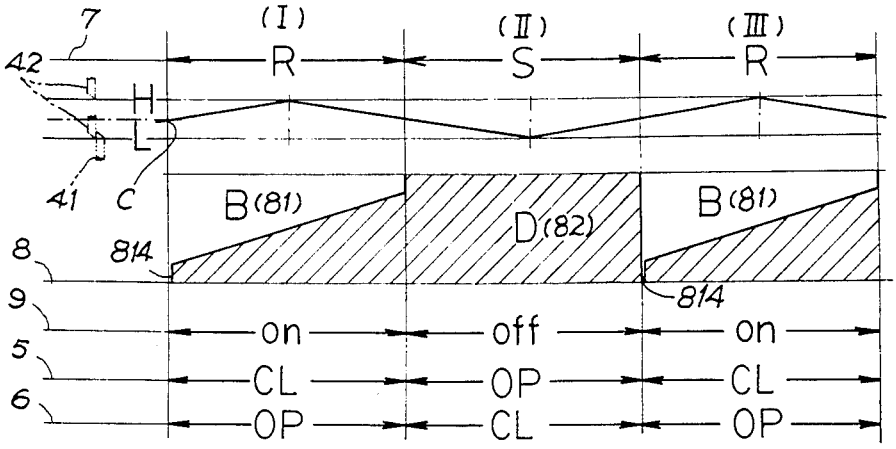
FIG. 5 is an illustration showing a sequence for operating the present invention.
Figure 6:
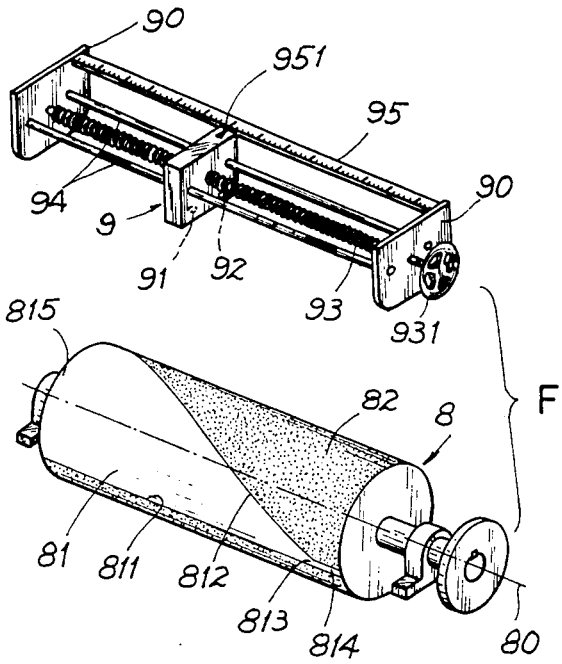
FIG. 6 is a more detailed illustration of the cylinder and photo controller as shown in FIG. 3.

When using the present invention, the eccentric-wheel transmission mechanism 3, the clutch 5 and brake 6, and the bright and dark color cylinder 8 are all synchronously driven by the motor 2 and driving shaft 24. The upper knife 42 should be always posed at an upper location such as a starting point C as shown in FIG. 5 higher than a fixed position of the lower knife 41 when stopped. The cylinder 8 should also be rotated to a bright-color area 81 such as at a starting point on the slit area 814. A power source is then applied to start the running of the present invention. The photo controller 9, as shown in column I of FIG. 5 showing an operation sequence of this invention, will sense the reflected light from the bright area 81 (B) on cylinder 8 to be an "on" condition, to thereb close (CL) the clutch 5 and open (OP) the brake 6. The output of the brake shaft 60 will be transmitted to drive the rollers 87 to forward the strip 71 to be cut. The upper knife 42 is continuously reciprocated with respect to the lower knife 41 as driven by the eccentric-wheel transmission mechanism 3. However, the upper knife 42 is moved upwardly from its starting point "C" to a highest position "H" and then downwardly moved to "C" as shown in column I in FIG. 5, thereby resulting in continuous forwarding (R) of strip 71 without being cut or obstructed by the knives 4.

When the machine is still running to shift column I to column II as shown in FIG. 5, the cylinder 8 will come to the dark area 82 (mark D in FIG. 5) to shield a light without sensing the photo controller 9 (off) to thereby close the brake 6 and open the clutch 5 to stop the running of rollers 7 (S) without forwarding the strip 71. However, the upper knife 42 is still moved downwardly from point "C" to a lowest position "L" to thereby cut off the strip at a desired length. Then, the operation is shifted from column II to III to repeat the operation cycles of the present invention. The slit area 814 defines a minimum distance of the bright-color area on cylinder 8 which thus senses a shortest cutting length of the strip article 71.

As shown in FIG. 4, the driving wheel 931 can be rotated to move the photo controller 9 along a longitudinal axis 80 of the cylinder 8, for instance, by moving the controller 9 from the base 815 of the triangle area 81 (linear length LB1), to a middle area (linear length LB2), since LB2 is less than LB1, the cylinder 8 will run from its bright area 81 to the dark area 82 in a shorter time period than that as running across the area of LB1. It means that the strip 61 can be cut at LB2 more quickly than at LB1 so that the cutting length as sensed from LB2 will be shorter than that at LB1. By the way, the cutting length as sensed at slit area 814 will be the minimum. The length of LB1 should be one half of the perimeter of the cylinder 8 and equal to the length of LD1 across the dark area 82 of cylinder 8.

The scale 95 is formed with graduations showing a cutting length of the strip 71 to be cut in proportion to a linear distance as circumferentially defined on the bright area 81 of the cylinder 8. The proportion of the cutting length shown on the scale 95 to the linear length of the cylinder periphery can be adjusted by proportionally adjusting the linear velocity of the rollers 7 to the linear velocity of the cylinder 8 diameter.

I claim:

1. An adjustable cutting-length controller for a cutting machine comprising:

a frame;

a driving motor coupled to a driving shaft rotatably mounted on said frame;

an eccentric-wheel transmission mechanism having an eccentric wheel mounted on said driving shaft, an eccentric link pivotally secured to the eccentric wheel, a crank means pivotally connected with said link and rotatably mounted on said frame, and a pair of vertically reciprocating rods pivotally secured to said crank means, said transmission mechanism synchronously driven by said motor;

a pair of cutting knives having an upper knife vertically reciprocating with respect to a lower knife along a vertical guide formed on said frame as driven by said reciprocating rods of said eccentric-wheel transmission mechanism, and the lower knife fixed under a level of a strip of article to be cut;

an electromagnetically-operating clutch of normal open having an input shaft coupled to said driving shaft;

an electromagnetically-operating brake of normal close having an output shaft coupled to a set of conveying rollers, said input shaft of said clutch operatively coupling said output shaft of said brake for transmitting an output from said driving shaft as synchronously driven by said driving shaft;

said set of conveying rollers forwarding said strip to be cut therebetween and being driven by said output shaft of said brake; a bright and dark color cylinder having a light reflecting bright-color area and a dark-area respectively disposed on a periphery of the cylinder, said cylinder having its rotatating shaft horizontally rotatably mounted on said frame and synchronously driven by said motor;

a photo-electric controller adjustably moving above said cylinder along an axis parallel to a longitudinal axis of said rotating shaft of said cylinder, including a photo sensor having a light emitter projecting a light beam toward said cylinder and a photoelectric cell receiving a light signal reflected from said bright color area of said cylinder or receiving no light signal from the dark area of said cylinder, said photo sensor transmitting and converting the light signal as sensed from said cylinder to an electric signal which is amplified to actuate a pair of relays for activating said clutch and said brake, whereby upon the sensing of said light signal from said bright color area of said cylinder, said normal-open clutch is closed and said normal-close brake is opened to drive said set of rollers for forwarding said strip;

whereas upon receiving no light signal from said dark area of said cylinder, said brake is closed and said clutch is opened to stop the running of said rollers and said strip which is adapted to be cut by said pair of cutting knives.

2. A cutting length controller according to claim 1, wherein said bright color area of said cylinder comprises a right triangle area having a base coinciding with a first circular plane of said cylinder, an altitude longitudinally formed on a periphery of said cylinder, a vertex formed approximately to a second circular plane opposite to the first circular plane, and a side leg diagonally connected between said vertex and said base; said dark area occupying the remaining area on said periphery of said cylinder.

3. A cutting length controller according to claim 2, wherein said bright-color area further comprises a bright-color slit area extending longitudinally from said vertex and said altitude of said triangle to the second circular plane to define a minimum cutting length of said strip to be cut.

4. A cutting length controller according to claim 1, wherein said photo controller further includes a screw engaged with said controller mounted horizontally across said frame, a pair of guide rods horizontally mounted across said frame for slidingly mounted said controller thereon, a driving wheel fixed on an outermost end of said screw for rotating said screw and adjustably moving said photo controller along said guide rods, a scale fixed on the frame in parallel with said screw adapted for the indication by a pointer formed on said controller; said scale formed with graduations thereon to show a cutting length of said strip of article to be cut.

5. A cutting length controller according to claim 4, wherein said graduations on said scale showing a cutting length of said strip being proportional to a linear length as circumferentially defined on said triangle bright-color area of said cylinder in parallel with said base of said triangle; the proportion of said cutting length of said strip to said linear length of said triangle bright area being adjusted by adjusting a linear velocity of said rollers to a linear velocity of said cylinder.

* * * * *